US005746308A

United States Patent [19]

Lin

[11] Patent Number: 5,746,308

[45] Date of Patent: May 5, 1998

[54] PUSH BUTTON SWITCH HAVING SCISSORS-TYPE ARM MEMBERS

[75] Inventor: San-Feng Lin, Taoyuan, Taiwan

[73] Assignee: Acer Peripherals, Inc., Japan

[21] Appl. No.: 758,686

[22] Filed: Dec. 2, 1996

[51] Int. Cl.[6] ..... H01H 3/12

[52] U.S. Cl. ..... 200/344

[58] Field of Search ..... 200/344

[56] References Cited

U.S. PATENT DOCUMENTS 5,399,822 3/1995 Sato et al. ..... 200/344

5,457,297 10/1995 Chen ..... 200/344

5,488,210 1/1996 Shigetaka et al. ..... 200/344

*Primary Examiner*—Renee S. Luebke

[57] ABSTRACT

A push button switch characterized in that the lower end of a second shaft, which slidably rotatably engages in the corresponding bearing portion of the baseplate, does not get in contact with the main flat surface of the baseplate during its movement. Therefore, the dimension tolerance in only one direction of the second shaft needs to be considered.

14 Claims, 10 Drawing Sheets

PUSH BUTTON SWITCH HAVING SCISSORS-TYPE ARM MEMBERS

TECHNICAL FIELD OF THE INVENTION

The invention relates to a push button switch, and in particular, to a push button switch having a baseplate bearing element in with a scissors-type arm element.

BACKGROUND OF THE INVENTION

The push button switch with scissors-type arm members is widely used in notebook type computers.

U.S. Pat. Nos. 5,512,719, 5,457,297, 4,433,225, 4,580,022, 4,902,862, 5,280,147, 5,329,084, 5,382,762, 5,399,822, 5,463,195, 5,466,901, 5,504,283, 5,519,569, 5,512,719, 5,278,371, 5,278,372 and 5,278,374 respectively disclose key switch of scissors-type plunger.

SUMMARY OF THE INVENTION

Main object of the invention is to provide an alternative push button switch having scissors-type arm members.

The improvement is characterized in that the lower end of a second shaft, which slidably rotatably engages in a corresponding bearing portion on the baseplate, does not get in contact with the main flat surface of the baseplate during its movement. Therefore, dimension tolerance in only one direction of the second shaft needs to be considered.

Other objects and advantages of the invention will be apparent from the following detailed descriptions of the invention together with the appended drawings.

BRIEF DESCRIPTION OF THE DRAWINGS

FIG. 7(*b*) illustrates a second arm element used with the first arm element disclosed in FIG. 7(*a*) to form a scissors-like plunger.

DETAILED DESCRIPTION OF THE INVENTION

Figure 1:
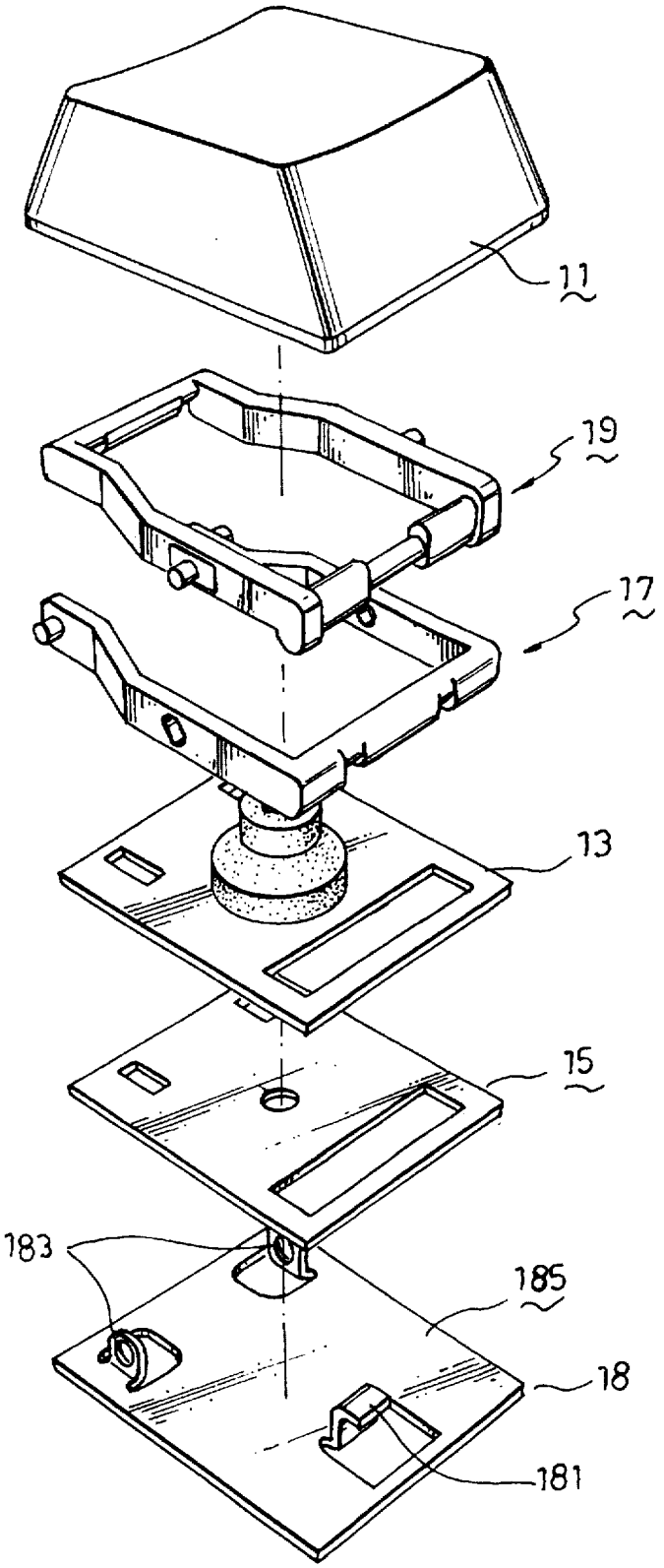
FIG. 1 shows the exploded view of the push button switch of the invention.

As shown in FIG. 1, a push button switch of the invention includes a key cap 11, a first arm element 19, a second arm element 17, an elastically deformable actuation device 13, a membrane switch 15 and a baseplate 18. The first arm element 19 and second arm element 17 are rotatably connected together to form a scissors-like plunger of the push button switch. The baseplate 18 has a main flat surface 185 and has a pair of receiving slots 183 and a bearing portion 181 formed thereon.

Figure 2:
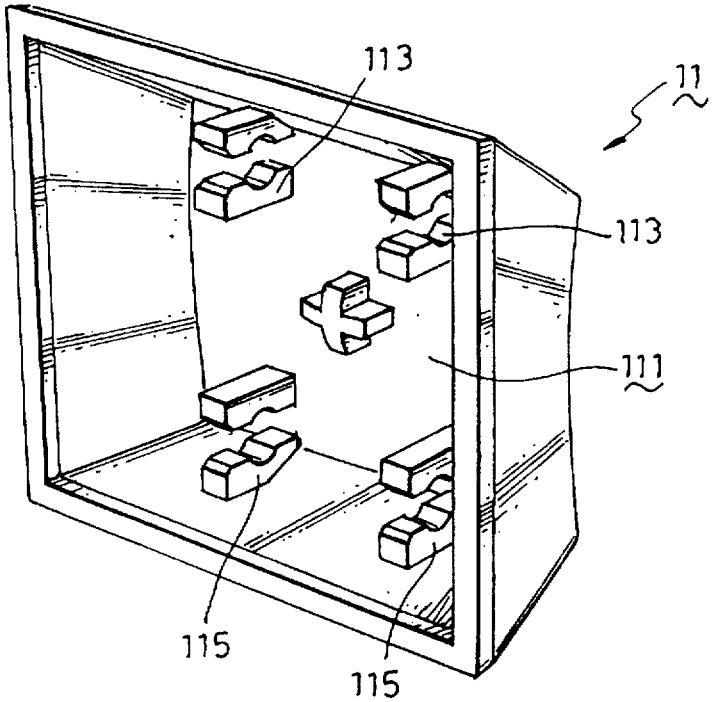
FIG. 2 shows the perspective view of the first embodiment of a key cap of the invention.

Referring to FIG. 2, the key cap 11 has a bottom surface 111. A first pair of spaced-apart bearing portions 113 and a second pair of spaced-apart bearing portions 115 are formed on the bottom surface 111 as shown in FIG. 2.

Figure 3:
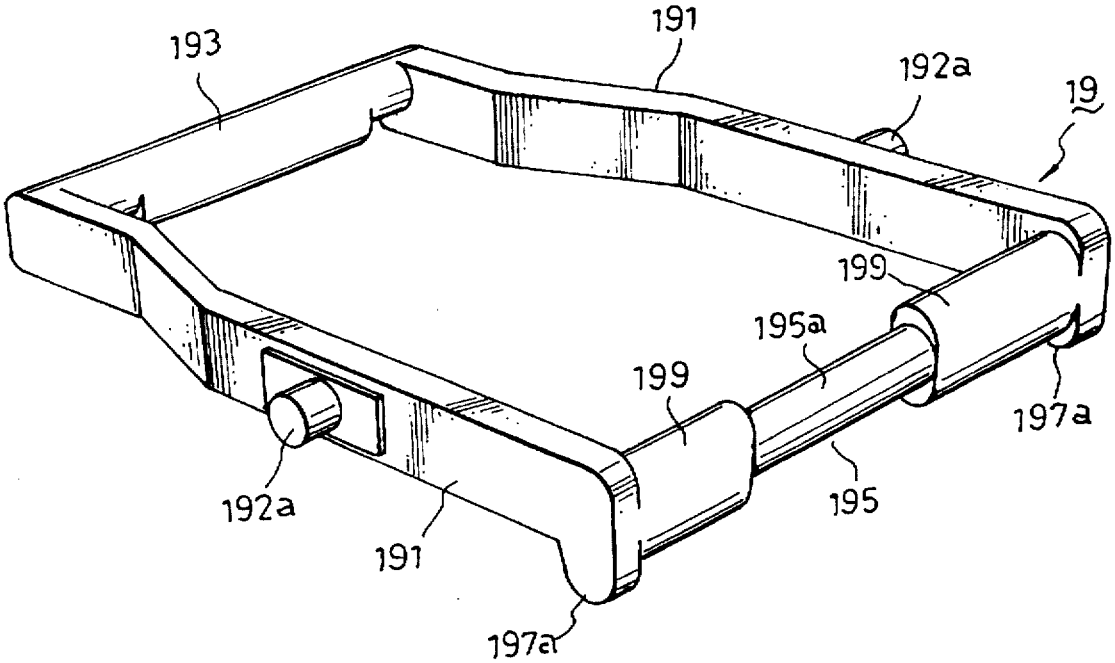
FIG. 3 shows the details of a. the first embodiment of first arm element 19 disclosed in FIG. 2.
Figure 5:
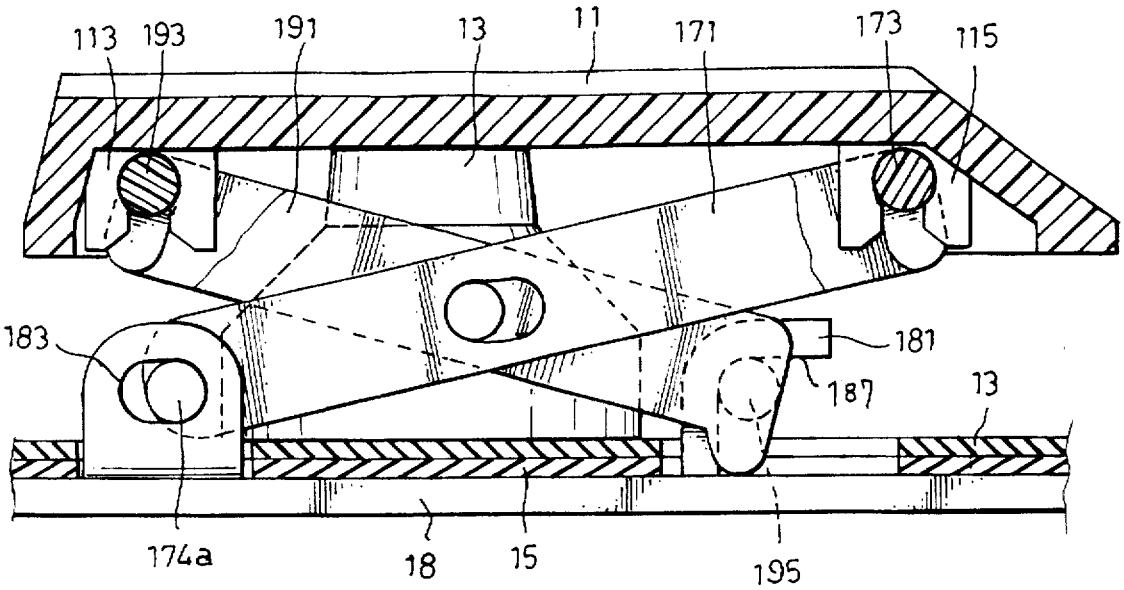
FIG. 5 shows a sectional view of the push button switch in assembly form having the first embodiment of the key cap 11, the first embodiment of the first arm element 19, the corresponding second arm element 17 and a baseplate 18.

As shown in FIG. 3, the first arm element 19 has a first shaft 193 provided at a first end thereof which is rotatably connected to the first pair of spaced-apart bearing portions 113 of the key cap 11. The first arm element 19 further includes a second shaft 195 provided at a second end thereof which is slidably rotatably received in the bearing portion 181 of the baseplate 18. During the operation of the switch, the upper surface 195*a* of the second shaft 195 slidably rotatably contacts an inner surface 187, shown in FIG. 5, of the bearing portion 181. However, the lower end of the second shaft 195 does not get in contact with the main flat surface 185 of the baseplate 18 during the operation of the switch as shown in FIG. 5. The first arm element 19 includes a first and a second side frames 191 provided to connect the first shaft 193 and the second shaft 195 at a first end portion and a second end portion thereof, respectively. A downward protrusion 197*a* is formed on the second end portion of each side frame 191 which slidably contacts the main flat surface 185 of the baseplate 18 during the operation of the switch, as shown in FIG. 5. In summary, during the operation of the switch, the upper surface 195*a* of the second shaft 195 slidably rotatably contacts the inner surface 187 of the bearing portion 181, and the downward protrusion 197*a* slidably contacts the main flat surface 185 of the baseplate 18.

Due to the characteristics of the invention, only a single dimension tolerance of the second shaft 195 with respect to the bearing portion 181 needs to be considered. Furthermore, for each downward protrusion 197*a*, which needs to be in a close contact with the main flat surface 185 of the baseplate 18, only a single dimension tolerance needs to be considered. This improvement provides advantages in the design and manufacture as well.

Figure 4:
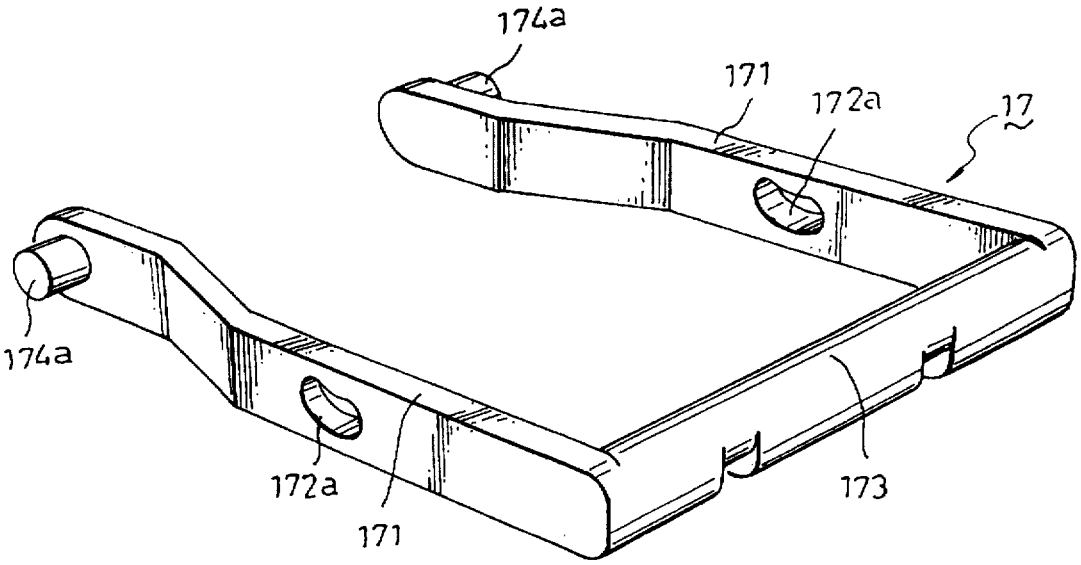
FIG. 4 shows the details of a second arm element 17 used with the first arm element 19 disclosed in FIG. 3 to form a scissors-like plunger.

As shown in FIG. 4, the second arm element 17 has a shaft 173 provided at an end thereof which is rotatably connected to the second pair of spaced-apart bearing portions 115 of the key cap 11. The second arm element 17 includes a first side frame 171 and a second side frame 171 both connected to the shaft 173 at a first end portion thereof. A pin 174*a* is provided at a second end portion of each of the first and second side frames 171, which is opposed to the first end portion, and is slidably rotatably received in a corresponding slot of the third pair of receiving slots 183 formed on the baseplate 18, as shown in FIG. 5.

Since the slots 172*a* are curved slots, the first arm member 19 and the second arm member 17 are slidably and rotatably connected together via connecting members 192*a* and corresponding slots 172*a* to form the scissors-type plunger in a conventional maneuver.

In one embodiment, the elastically deformable actuation device 13 is disposed under the key cap 11, as shown in FIG. 5, and it gets deformed with the up-and-down movement of the key cap 11.

The membrane switch 15 is used in a conventional manner for on-off control of a piece of electrical equipment (not shown), in response to a deformation status of the actuation device 13.

The first arm element 29, and the second arm element 27 of the second embodiment of the invention described hereinafter are respectively the same as those of the first embodiment shown in FIG. 3 and FIG. 4 except for the connecting relationship therebetween. That is, the first arm member 29 and the second arm member 27 are rotatably connected together via connection members 292*a* and corresponding slots 272*a* to form the scissors-type plunger without relative slide movement between them, as shown in FIG. 6.

Figure 6:
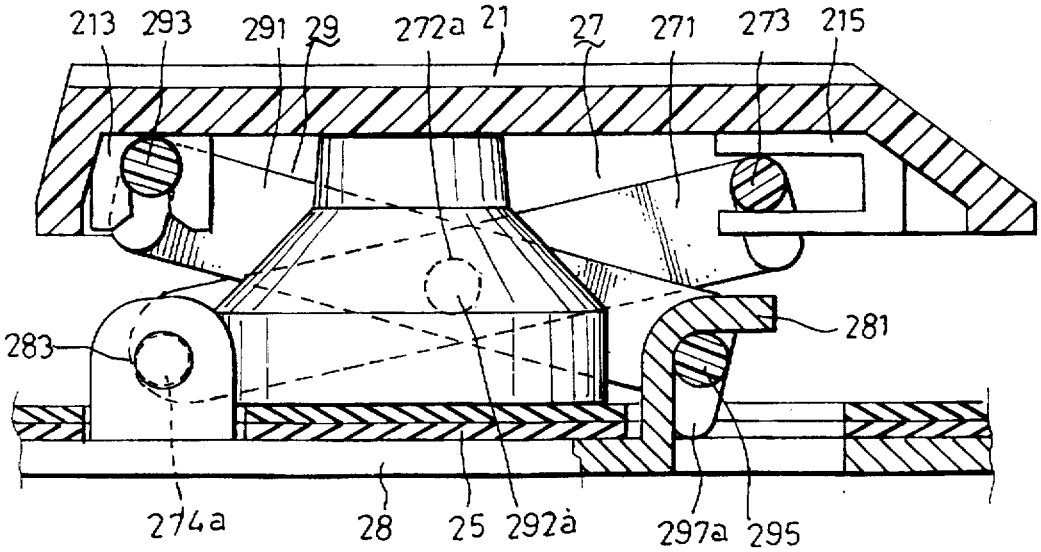
FIG. 6 shows a sectional view of the push button switch in assembly form having a second embodiment of a key cap 21, a first embodiment of a first arm element 29, the corresponding second arm element 27 and the corresponding baseplate 28.

As shown in FIG. 6 of the second embodiment of the invention, the first arm element 29 has a first shaft 293 provided at a first end thereof which is rotatably connected to the first pair of spaced-apart bearing portions 213 of the second embodiment of the key cap 21. The first arm element 29 includes a second shaft 295 provided at a second end thereof which is slidably rotatably received in the bearing portion 281 of the baseplate 28. During the operation of the switch, the upper surface of the second shaft 295 slidably rotatably contacts with the inner surface of the bearing portion 281. The lower end of the second shaft 295 does not contact with the main flat surface of the baseplate 28 during the operation of the switch as shown in FIG. 6. The first arm element 29 includes a first and a second side frame 291 provided to connect the first shaft 293 and the second shaft 295 at a first end portion and a second end portion thereof, respectively. A downward protrusion 297*a* is formed on the second end portion of each side frame 291 which slidably contacts with the main flat surface 285 of the baseplate 28 during the operation of the switch, as shown in FIG. 6.

Contrary to FIG. 5, the shaft 273 which is provided at a first end of the second arm element 27 is slidably rotatably connected to the second pair of spaced-apart bearing portions 215 of the key cap 21. The second arm element 27 includes a first side frame 271 and a second side frame 271 both connected to the shaft 273 at a first end portion thereof. A pin 274*a* is provided at a second end portion of each of the first and second side frames 271, which is opposed to the first end portion, and is rotatably received in each corresponding slot of the third pair of receiving slots 283 formed on the baseplate 28 without a sliding movement.

As shown in the first embodiment of FIG. 5, only a single dimension tolerance of the second shaft 295 with respect to the bearing portion 281 needs to be considered. Furthermore, for each downward protrusion 297*a*, which needs to be in a close contact with the main flat surface of the baseplate 28, only a single dimension tolerance needs to be considered. This improvement results in advantages in the design and manufacture as well.

Other aspects of the invention include variations in the type of the connections between the first and second arm elements, and in a mechanism associated with the action of an elastically deformable actuation device 13 (see p. 4, lines 3–4).

Figure 7A:
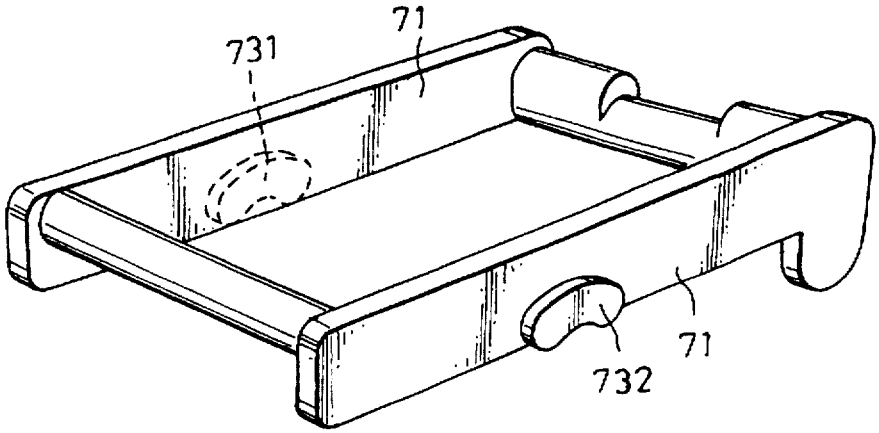
FIG. 7(*a*) illustrates the second embodiment of the first arm element of the invention.
Figure 7B:
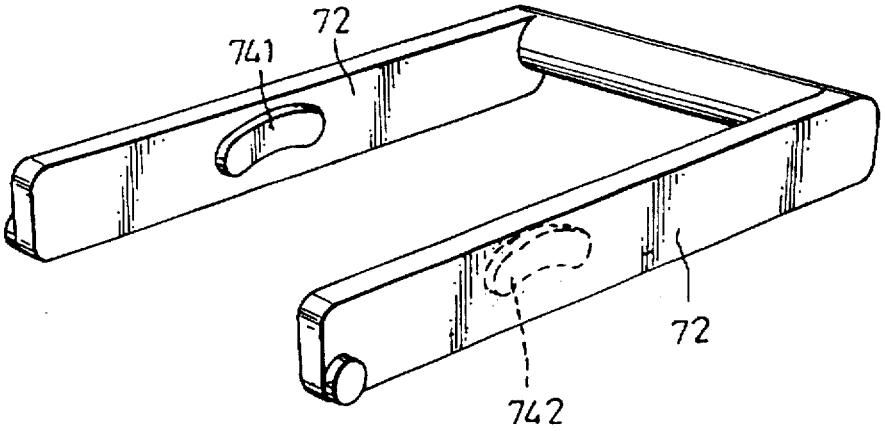
Figure 8A:
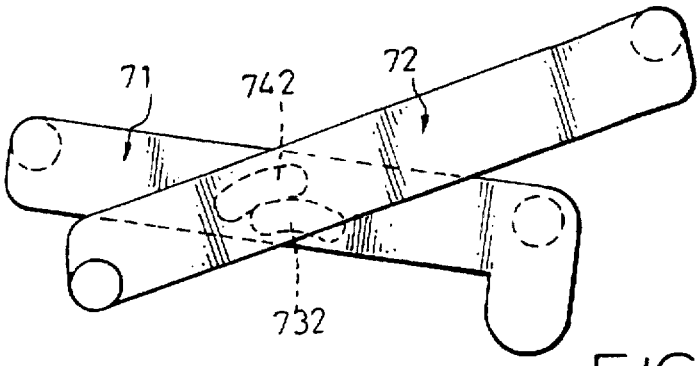
FIGS. 8A–8D illustrate the operation of a scissors-like plunger constructed from the arm elements shown in FIG. 7(*a*) and FIG. 7(*b*).
Figure 8B:
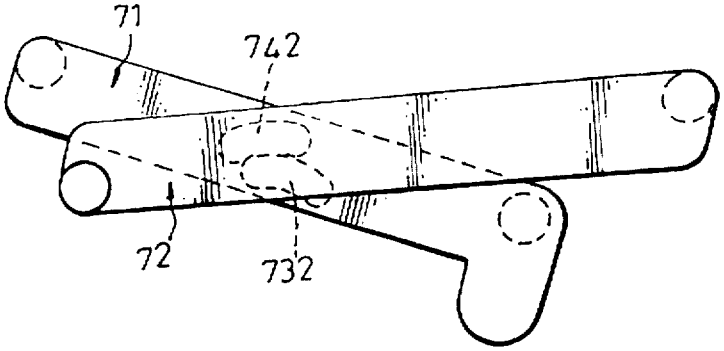
Figure 8C:
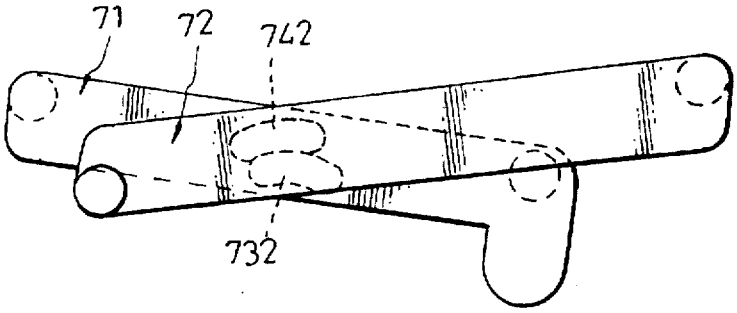
Figure 8D:
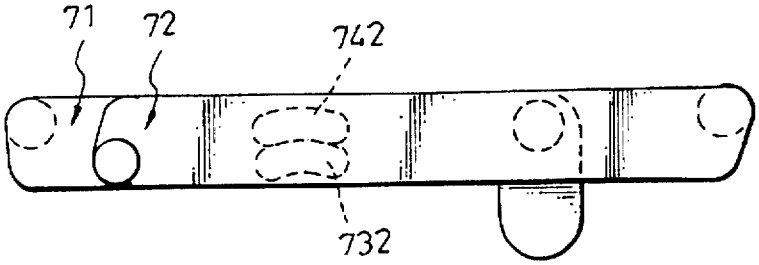

In accordance with the second embodiment of the first arm element shown in FIG. 7(*a*), a pair of heart-like protrusions 731, 732 are formed on the external sides of the side frames 71. Accordingly, a pair of corresponding heart-like protrusions 741, 742 are formed on the internal sides of the side frames 72 of the second arm element, as shown in FIG. 7(*b*). A lower surface of protrusion 731 intersects with the upper surface of the protrusion 741, and a lower surface of protrusion 742 intersects with a upper surface of the protrusion 732, when the first and second arm elements are assembled to form the scissors-like plunger. FIGS. 8A–8D illustrate the operation of the scissors-like plunger constructed with the first and second arm elements shown in FIG. 7.

Figure 9:
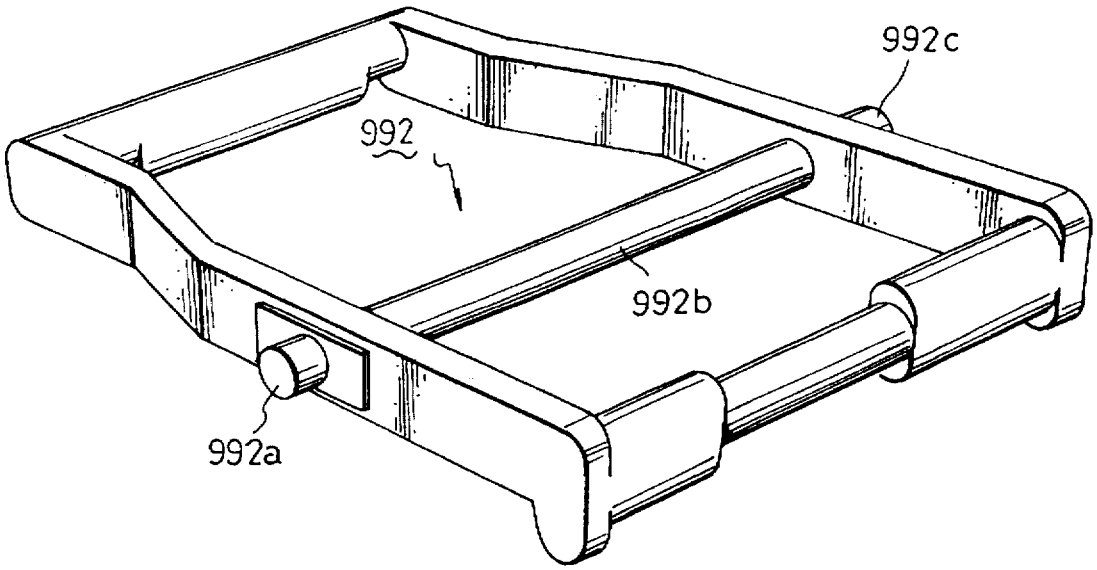
FIG. 9 illustrates the third embodiment of the first arm element of the invention.

Compared with the first embodiment of the first arm element disclosed in FIG. 3, the third embodiment of the first arm element shown in FIG. 9 has an axle 992 running across the width of the first arm element. The two ends 992*a*, 992*c* of the axle 992 have the function as the connection element 192*a* with the corresponding slot 172*a* of the first embodiment of second arm element disclosed in FIG. 4. The middle section 992*b* of the axle 992 functions to press the elastically deformable actuation device placed underneath it when the scissors-like plunger moves downward.

Figure 10:
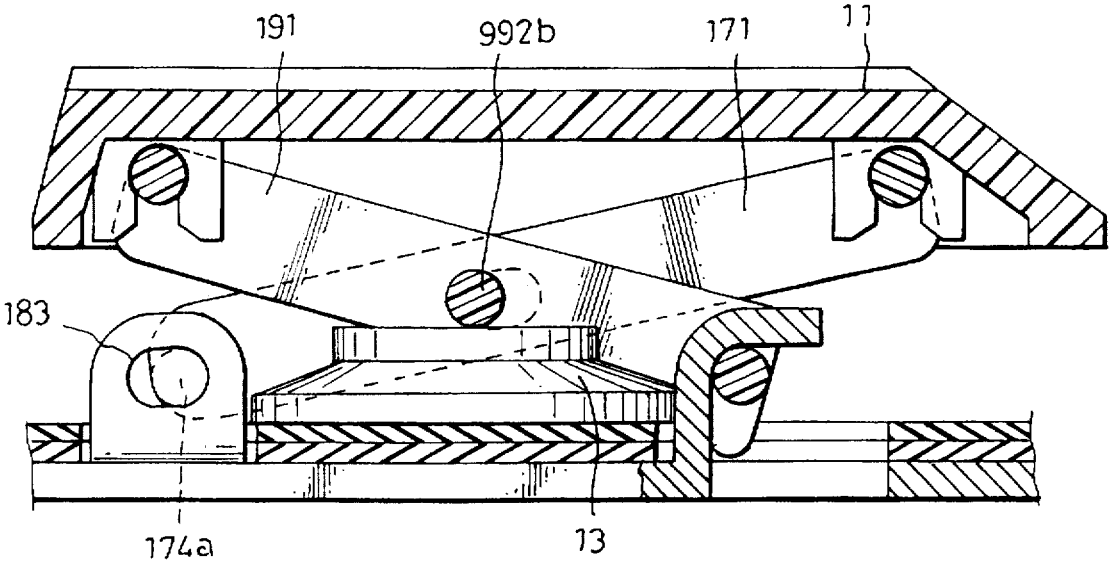
FIG. 10 is a sectional view of the push button switch in an un-depressed condition constructed from the third embodiment of the first arm element disclosed in FIG. 9 with the first embodiment of the key cap disclosed in FIG. 2.

The push button switch consists of the third embodiment of the first arm element and the first embodiment of the key cap 11 is shown in FIG. 10 in its un-depressed condition to illustrate functioning of the axle 992*b*. In this embodiment, during the operation of the switch, the pin 174*a* of each of the side frames 171 is slidably rotatably received in the third pair of the receiving slots 183 formed on the baseplate 18. On the other hand, the axle 992 functions to slidably and rotatably connect the first arm element and second arm element together. As the key cap 11 is depressed downward, the axle 992 moves downward with it and the middle section 992*b* of the axle 992 then presses the elastic element 13 downward to actuate the membrane switch placed underneath.

Figure 11:
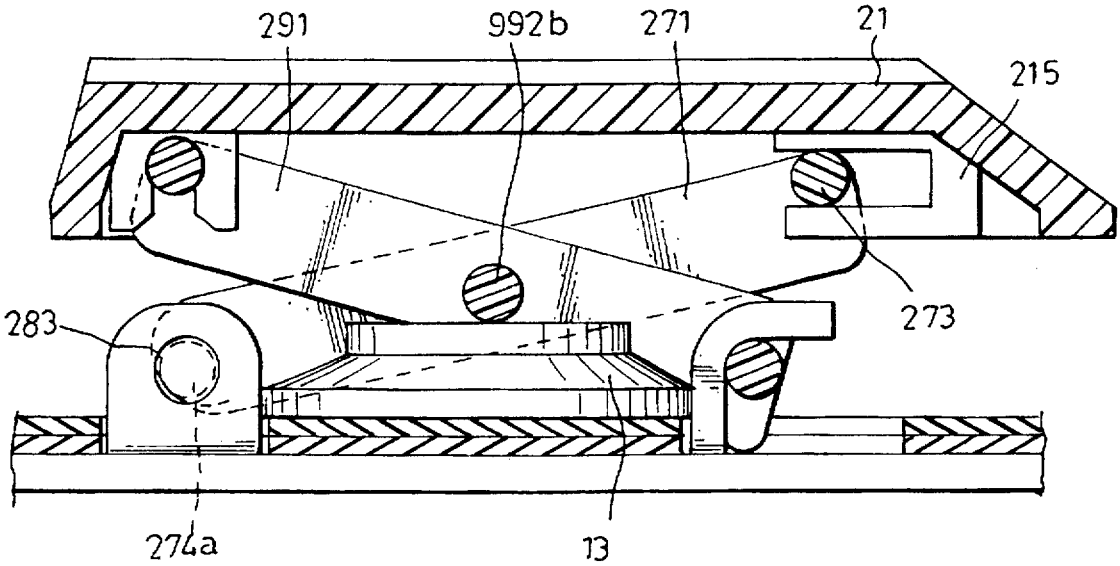
FIG. 11 is a sectional view of the push button switch in an un-depressed condition constructed from the third embodiment of the first arm element discloses FIG. 9 with the second embodiment of the key cap disclosed in FIG. 6.

The push button switch which consists of the third embodiment of the first arm element and the second embodiment of the key cap is shown in FIG. 11 in its un-depressed condition to illustrate functioning of the axle 992*b*. In this embodiment, during the operation of the switch, the shaft 273 is slidably rotatably connected to the second pair of spaced-apart bearing portions 215 of the key cap 21. On the other hand, the axle 992 functions to rotatably connect the first arm element and second arm element. As the key cap 21 is depressed downward, the axle 992 moves downward with it and the middle section 992*b* of axle 992 then presses the elastic element 13 downward to actuate the membrane switch placed underneath.

Figure 12:
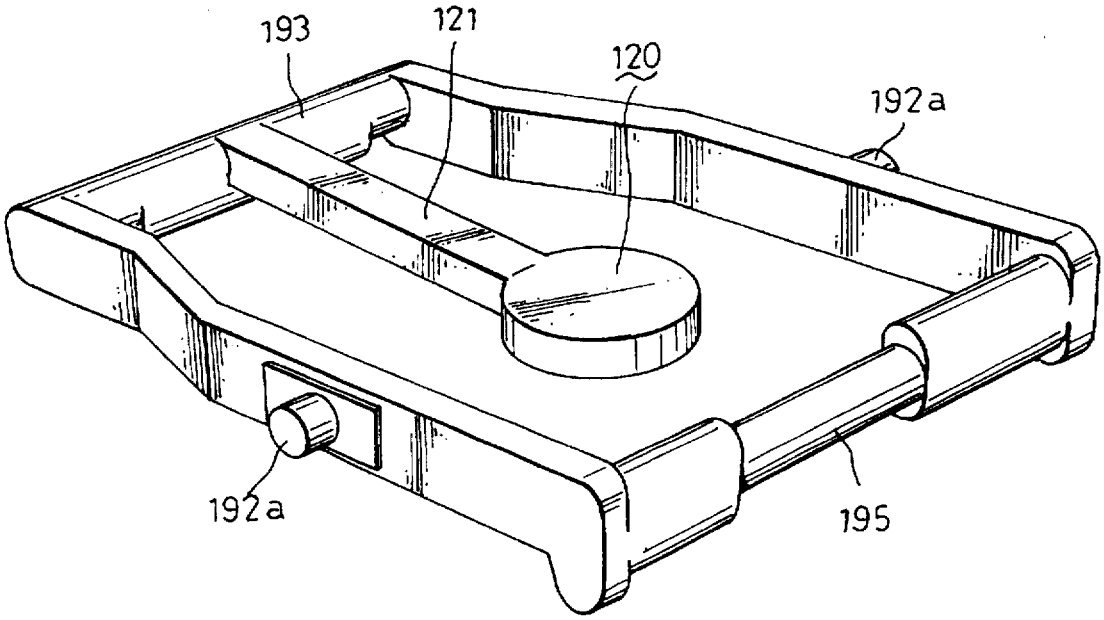
FIG. 12 illustrates the fourth embodiment of the first arm element of the invention.

Compared with the first embodiment of the first arm element disclosed in FIG. 3, the fourth embodiment of the first arm element as shown in FIG. 12 has a manipulator 121 which has a first end fixedly connected to the first shaft 193 of the first arm element. The manipulator 121 has a second end 120 contacting an upper surface of the elastically deformable actuation device 13. Upon depression of the key cap, the second end 120 of the manipulator 121 presses the elastically deformable actuation device 13 to actuate the switch element, and makes it electrically conductive.

Figure 13:
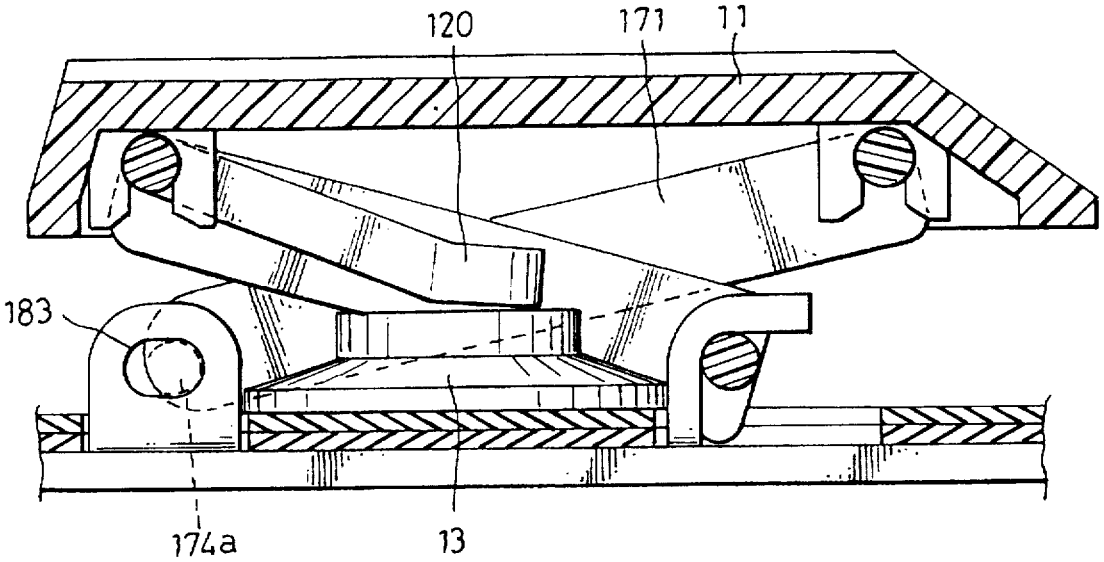
FIG. 13 is a sectional view of the push button switch in an un-depressed condition constructed from the fourth embodiment of the first arm element disclosed in FIG. 12 with the first embodiment of the key cap.

In its un-depressed condition the push button switch which consists of the fourth embodiment of the first arm element and the first embodiment of the key cap 11 is shown in FIG. 13. In this embodiment, during the operation of the switch, the pin 174*a* of each of the side frames 171 is slidably rotatably received in the third pair of receiving slots 183 formed on the baseplate 18. As the key cap 11 is depressed downward, the second end 120 of the manipulator 121 moves downward with it to press the elastically deformable actuation device 13 downward to actuate the membrane switch placed underneath.

Figure 14:
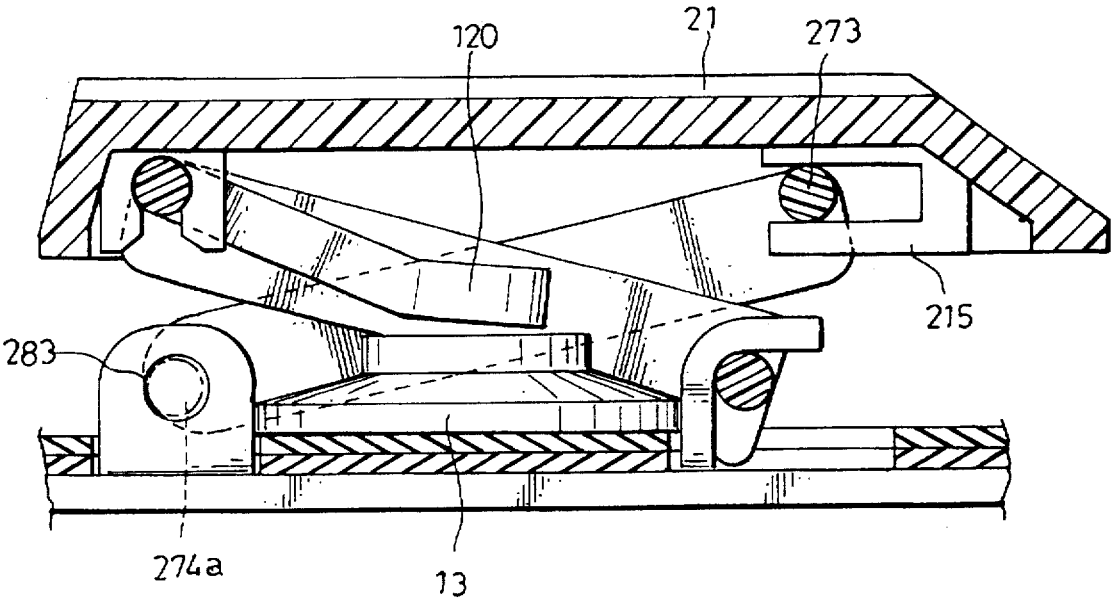
FIG. 14 in a sectional view of the push button switch in an un-depressed condition constructed from the fourth embodiment the first arm element disclosed in FIG. 12 with the second embodiment of the key cap.

The push button switch which consists of the fourth embodiment of first arm element and the second embodiment of the key cap 21 is shown in its un-depressed condition in FIG. 14. In this embodiment, during the operation of the switch, the shaft 273 is slidably rotatably connected to the second pair of spaced-apart bearing portions 215 of the key cap 21. As the key cap 21 is depressed downward, the second end 120 of the manipulator 121 moves downward with it to press the elastically deformable actuation device 13 downward to actuate the membrane switch placed underneath.

I claim:

1. A push button switch comprising:

a key cap having a top and a bottom surface, a first pair of spaced-apart bearing portions and a second pair of spaced-apart bearing portions formed on the bottom surface;

a baseplate having a pair of receiving slots and a single baseplate bearing portion formed on the baseplate, the single baseplate bearing portion displaced from each receiving slot by substantially the same distance, the baseplate having a main flat surface;

a switch element which selectively electrically conducts in response to up-and-down motion of the key cap;

an internal arm element having a closed shape and two ends, the internal arm element having a first shaft provided at the first end thereof, the first shaft being rotatably connected to the first pair of spaced-apart bearing portions and having first and second end portions, the internal arm element further including a second shaft provided at the second end thereof, the second shaft being slidably rotatably received in the single baseplate bearing portion and having first and second end portions, the internal arm element including a first side frame and a second side frame to connect the first shaft and the second shaft at the first and second end portions of the shafts;

an external arm element having a U-shape, the external arm element having a third shaft provided at an end thereof, the third shaft being rotatably connected to the second pair of spaced-apart bearing portions, the external arm element including a third side frame and a fourth side frame, each having opposed first and second end portions, each connected to the third shaft at its first end portion, and each having, a pin provided at its second end portion, the pin being slidably rotatably received in the pair of receiving slots.

2. The push button switch according to claim 1, further comprising a traverse pivot axle, wherein the internal and external arm elements are pivotally joined with the traverse pivot axle.

3. The push button switch according to claim 2, further comprising an elastic member, wherein the elastic member is located between the traverse pivot axle and the baseplate, and, upon depression of the key cap, the traverse pivot axle presses the elastic member to actuate the switch element and to cause it to conduct electrically.

4. The push button switch according to claim 1, further comprising a pair of protrusions formed on one of the arm elements and a pair of corresponding curved slots formed on the other one of the arm elements, wherein the internal and external arm elements are slidably and rotatably joined together by a pair of protrusions formed on one of the arm elements and a pair of corresponding curved slots formed on the other one of the arm elements.

5. The push button switch according to claim 1, further comprising an elastic element, located between the key cap and the baseplate, wherein upon depression of the key cap, the key cap presses the elastic member to actuate the switch element and to cause it to conduct electrically.

6. The push button switch according to claim 1 further comprising an elastic member which has an upper surface, wherein:

the internal arm element further comprises a manipulator having a first and a second end, the first end fixedly connected to the internal arm element;

the elastic member is located between the manipulator and the baseplate and the second of the manipulator contacts the upper surface of the elastic member, and, upon depression of the key cap, the second end of the manipulator presses the elastic member to actuate the switch element and to cause it to conduct electrically.

7. A push button switch comprising:

a key cap having a top and a bottom surface, a first pair of spaced-apart bearing portions and a second pair of spaced-apart bearing portions formed on the bottom surface;

a baseplate having a pair of receiving slots and a single baseplate bearing portion formed on the baseplate, the single baseplate bearing portion displaced from each receiving slot by substantially the same distance, the baseplate having a main flat surface;

a switch element which selectively electrically conducts in response to up-and-down motion of the key cap;

an internal arm element having a closed shape and two ends, the internal arm element having a first shaft provided at the first end thereof, the first shaft being rotatably connected to the first pair of spaced-apart bearing portions and having first and second end portions, the internal arm element further having a second shaft provided at the second end thereof, the second shaft being slidably rotatably received in the single baseplate bearing portion and having first and second end portions, the internal arm element including a first side frame and a second side frame to connect the first shaft and the second shaft at the first and second end portions of the shafts;

an external arm element having a U-shape, the external arm element having a third shaft provided at an end thereof, the third shaft being slidably rotatably connected to the second pair of spaced-apart bearing portions, the external arm element including a third side frame and a fourth side frame, each having opposed first and second end portions, each connected to the third shaft at its first end portion, and each having, a pin provided at its second end portion, the pin being rotatably received in the pair of receiving slots.

8. The push button switch according to claim 7, further comprising a traverse pivot axle, wherein the internal and external arm elements are pivotally joined with the traverse pivot axle.

9. The push button switch according to claim 8, further comprising an elastic member, located between the traverse pivot axle and the baseplate, wherein, upon depression of the key cap, the traverse pivot axle presses the elastic member to actuate the switch element and to cause it to conduct electrically.

10. The push button switch according to claim 7, further comprising a pair of protrusions formed on one of the arm elements and a pair of corresponding curved slots formed on the other one of the arm elements, wherein the internal and external arm elements are rotatably joined together by a pair of protrusions formed on one of the arm elements and a pair of corresponding curved slots formed on the other one of the arm elements.

11. The push button switch according to claim 7, further comprising an elastic element, located between the key cap and the baseplate, wherein, upon depression of the key cap, the key cap presses the elastic member to actuate the switch element and to cause it to conduct electrically.

12. The push button switch according to claim 7 further comprising an elastic member which has an upper surface, wherein:

the internal arm element further comprises a manipulator having a first and a second end, the first end fixedly connected to the internal arm element; and the elastic member is located between the manipulator and the baseplate, and the second end of the manipulator contacts the upper surface of the elastic member, and, upon depression of the key cap, the second end of the manipulator presses the elastic member to actuate the switch element and to cause it to conduct electrically.

13. A push button switch comprising:

a key cap having a top and a bottom surface, a first pair of spaced-apart bearing portions and a second pair of spaced-apart bearing portions being formed on the bottom surface;

a baseplate having a pair of receiving slots and a single baseplate bearing portion formed on the baseplate, the single baseplate bearing portion displaced from each receiving slot by substantially the same distance, and having a predetermined length, the baseplate having a main flat surface;

a switch element which selectively electrically conducts in response to up-and-down motion of the key cap;

an internal arm element having a closed shape and two ends, the internal arm element having a first shaft provided at the first end thereof, the first shaft being rotatably connected to the first pair of spaced-apart bearing portions and having first and second end portions, the internal arm element further having a second shaft provided at the second end thereof, the second shaft being slidably rotatably received in the single baseplate bearing portion and having first and second end portions and a center portion along the axial direction thereof, the center portion having a smaller radial dimension than the first and second end portions, a length substantially equal to the predetermined length of the single baseplate bearing portion, and being slidably rotatably received in the single baseplate bearing portion, the internal arm element including a first side frame and a second side frame to connect the first shaft and the second shaft at the first and second end portions of the shafts;

an external arm element having a third shaft provided at an end thereof, the third shaft being rotatably connected to the second pair of spaced-apart bearing portions, the external arm element including a third side frame and a fourth side frame, each having opposed first and second end portions, each connected to the third shaft at its first end portion, and each having a pin provided at its second end portion, the pin being slidably rotatably received in the pair of receiving slots.

14. A push button switch comprising:

a key cap having a top and a bottom surface, a first pair of spaced-apart bearing portions and a second pair of spaced-apart bearing portions being formed on the bottom surface;

a baseplate having a pair of receiving slots and a single baseplate bearing portion formed on the baseplate, the single baseplate bearing portion displaced from each receiving slot by substantially the same distance, and having a predetermined length, the baseplate having a main flat surface;

a switch element which selectively electrically conducts in response to up-and-down motion of the key cap;

an internal arm element having a closed shape and two ends, the internal arm element having a first shaft provided at the first end thereof, the first shaft being rotatably connected to the first pair of spaced-apart bearing portions and having first and second end portions, the internal arm element further including a second shaft provided at the second end thereof, the second shaft being slidably rotatably received in the single baseplate bearing portion and having first and second end portions and a center portion along the axial direction thereof, the center portion having a smaller radial dimension than the first and second end portions, a length substantially equal to the predetermined length of the single baseplate bearing portion, and being slidably rotatably received in the single baseplate bearing portion, the internal arm element including a first side frame and a second side frame to connect the first shaft and the second shaft at the first and second end portions of the shafts;

an external arm element having a third shaft provided at an end thereof, the third shaft being slidably rotatably connected to the second pair of spaced-apart bearing portions, the external arm element including a third side frame and a fourth side frame, each having opposed first and second end portions, each connected to the third shaft at its first portion, and each having a pin provided at its second end portion, the pin being rotatably received in the pair of receiving slots.

* * * * *